US008049433B2

(12) United States Patent
Han

(10) Patent No.: US 8,049,433 B2
(45) Date of Patent: Nov. 1, 2011

(54) INVERTER CIRCUIT AND LAMP CONTROL APPARATUS HAVING THE SAME

(75) Inventor: Jae Hyun Han, Gwangju (KR)

(73) Assignee: LG Innotek Co., Ltd., Seoul (KR)

( * ) Notice: Subject to any disclaimer, the term of this patent is extended or adjusted under 35 U.S.C. 154(b) by 324 days.

(21) Appl. No.: 12/439,217

(22) PCT Filed: Apr. 17, 2008

(86) PCT No.: PCT/KR2008/002181

§ 371 (c)(1),
(2), (4) Date: Feb. 27, 2009

(87) PCT Pub. No.: WO2008/130138

PCT Pub. Date: Oct. 30, 2008

(65) Prior Publication Data

US 2010/0001655 A1 Jan. 7, 2010

(30) Foreign Application Priority Data

Apr. 18, 2007 (KR) ..... 10-2007-0037773

(51) Int. Cl.
*H05B 41/16* (2006.01)
*G09G 3/28* (2006.01)

(52) U.S. Cl. ..... 315/282; 315/76; 315/224; 315/291; 315/209 R; 345/66; 345/102; 345/212; 345/204

(58) Field of Classification Search ..... 315/274–289, 315/247, 209 R, 224, 225, 291, 307; 345/66, 345/102, 204, 211–214
See application file for complete search history.

(56) References Cited

U.S. PATENT DOCUMENTS 6,507,176 B2 * 1/2003 Wittenbreder, Jr. ..... 323/259
2006/0097655 A1 5/2006 Takahashi et al.

FOREIGN PATENT DOCUMENTS

KR 10-2004-0065534 7/2004
KR 10-2006-0011353 2/2006

* cited by examiner

*Primary Examiner* — Tuyet Thi Vo
(74) *Attorney, Agent, or Firm* — Saliwanchik, Lloyd & Eisenschenk

(57) ABSTRACT

Disclosed is an inverter circuit. The inverter circuit comprises a transformer comprising a primary coil and a secondary coil wound at a predetermined turn ratio, a first switch circuit comprising first and second switch devices commonly connected with a first end of the primary coil of the transformer, a second switch circuit comprising third and fourth switch devices commonly connected with a second end of the primary coil of the transformer, and a third switch circuit comprising fifth and sixth switch devices commonly connected with a part of the primary coil of the transformer.

20 Claims, 7 Drawing Sheets

[Fig. 1]
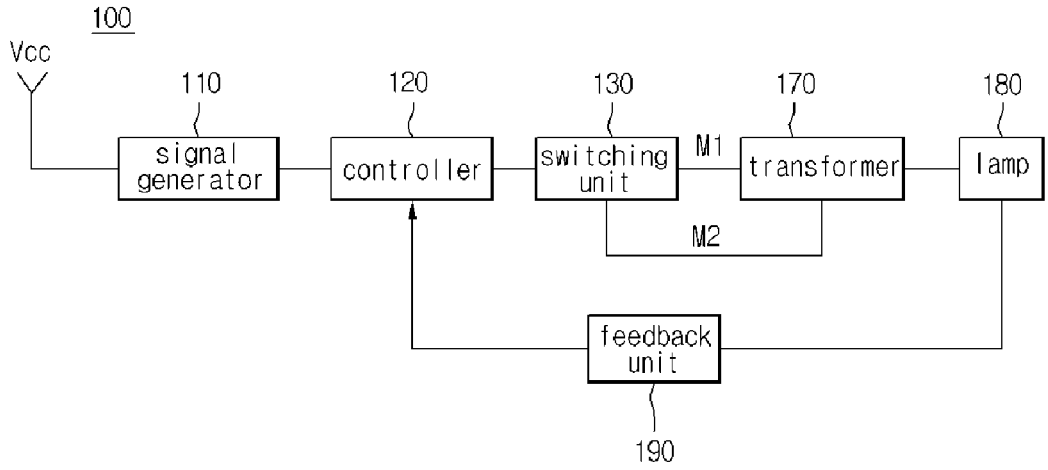
[Fig. 2]
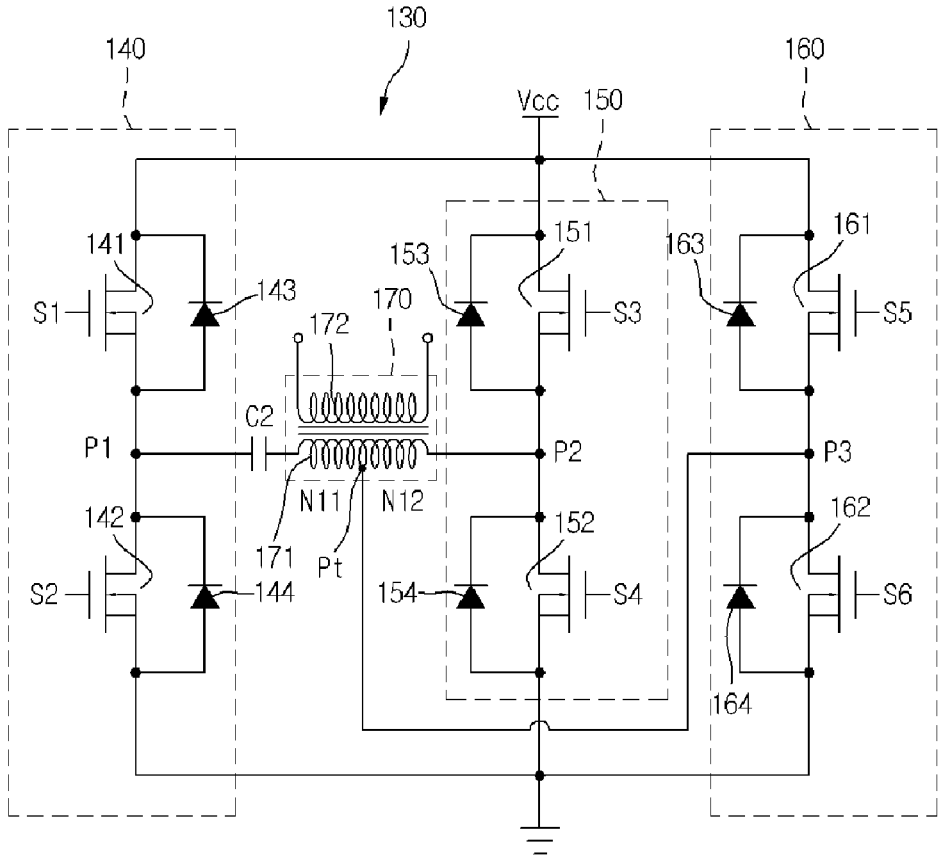

[Fig. 3]
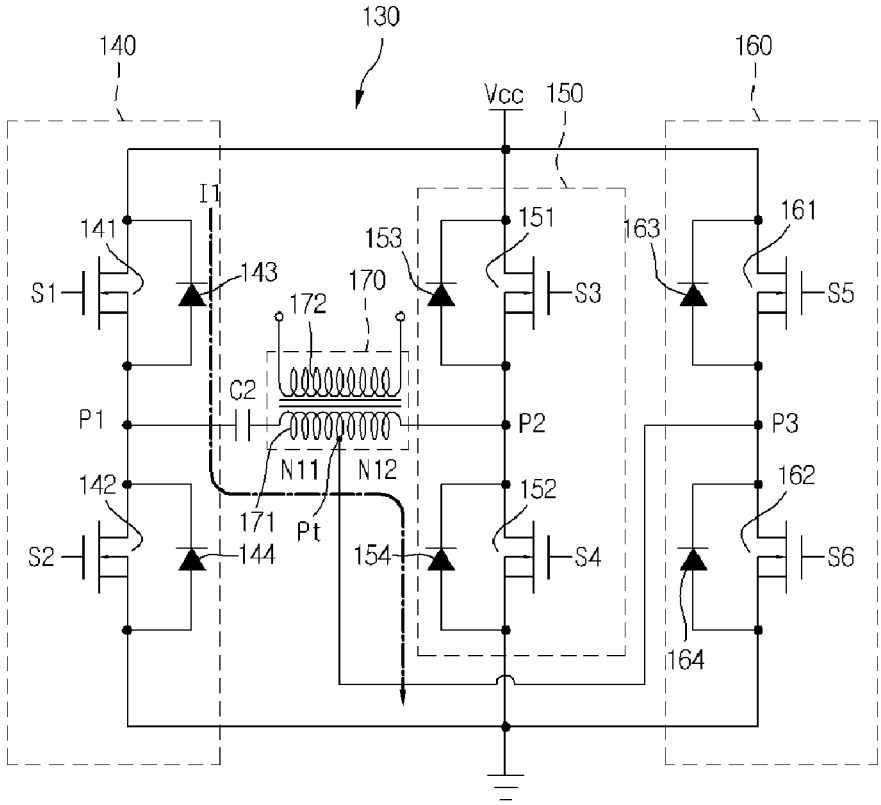
[Fig. 4]
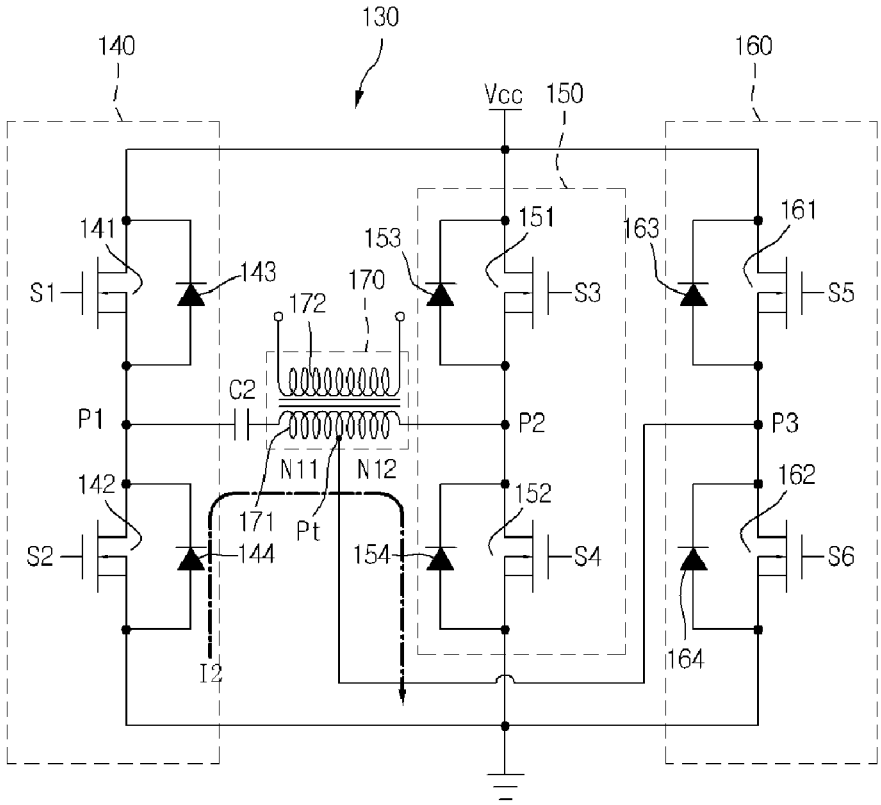

[Fig. 5]
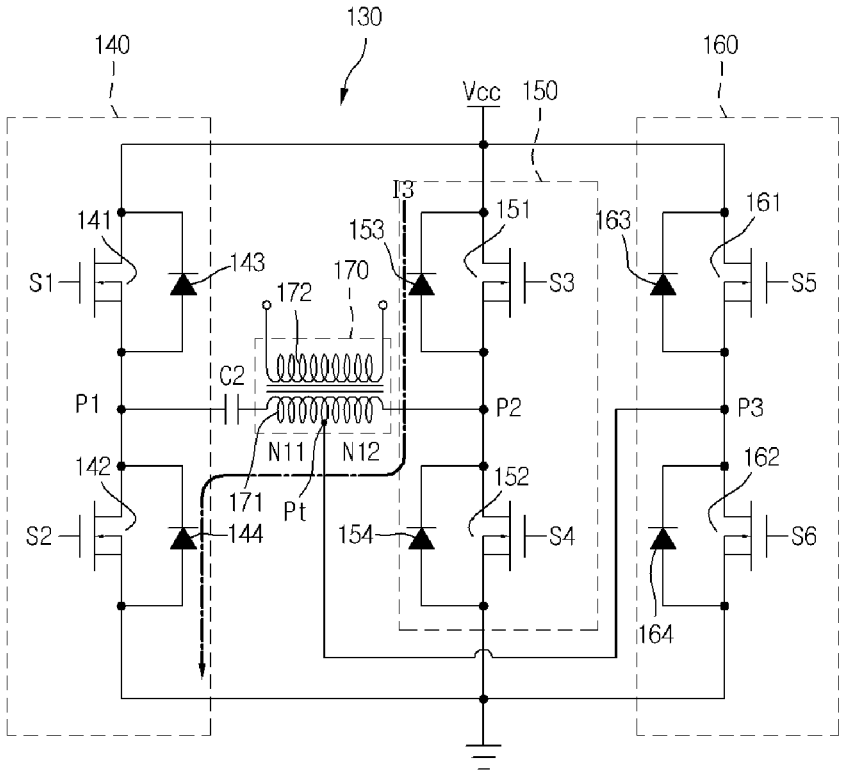
[Fig. 6]
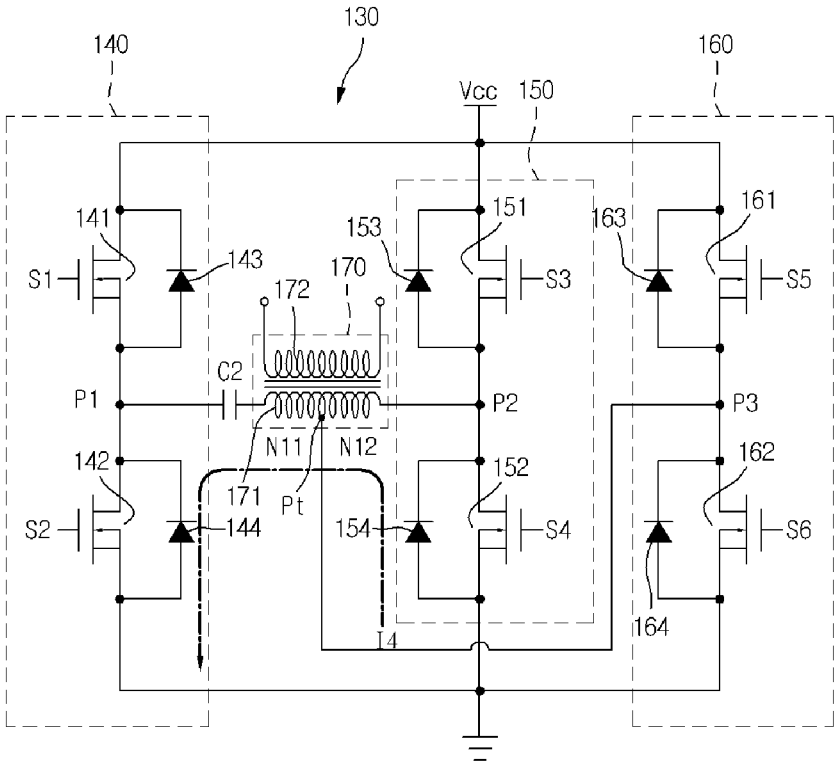

[Fig. 7]
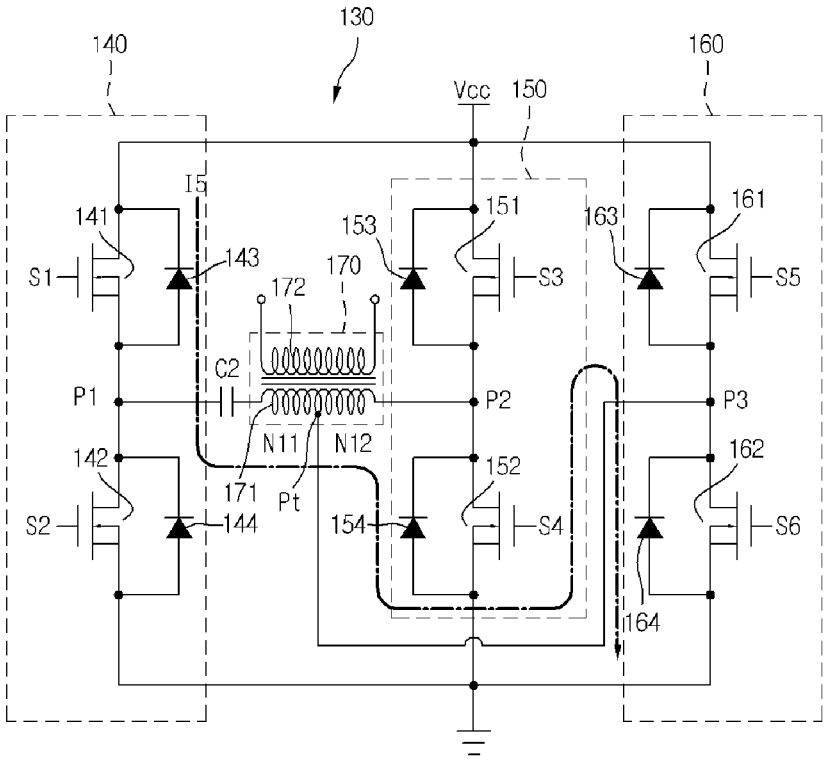
[Fig. 8]
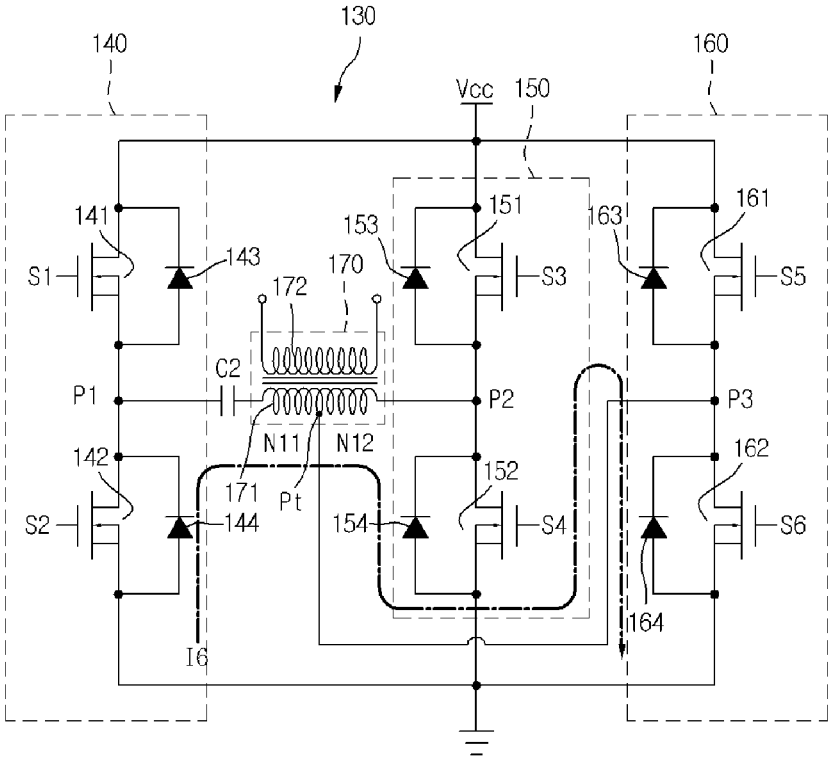

[Fig. 9]
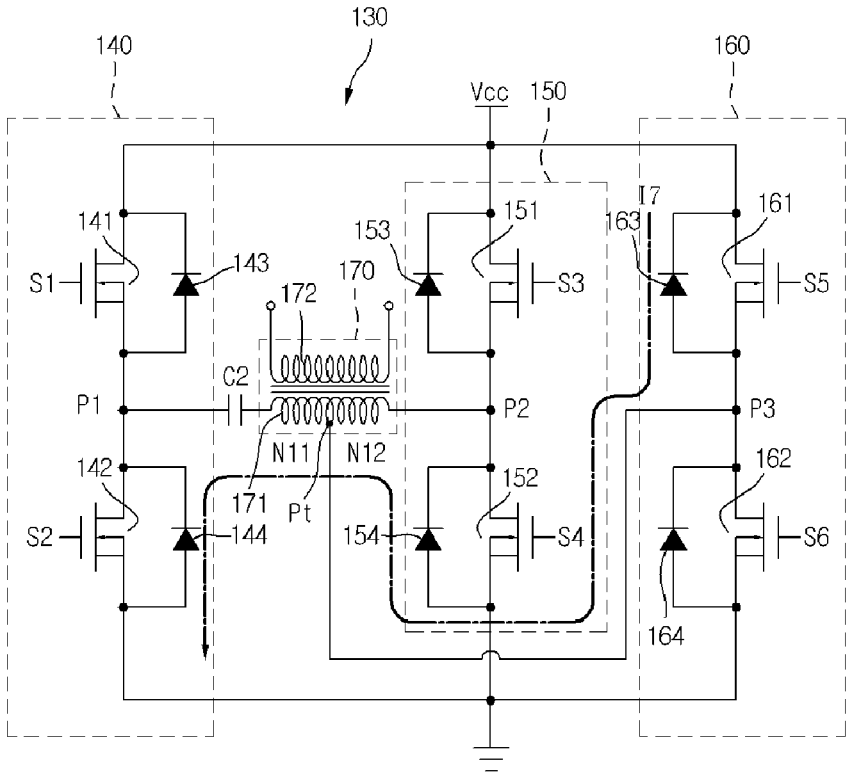
[Fig. 10]
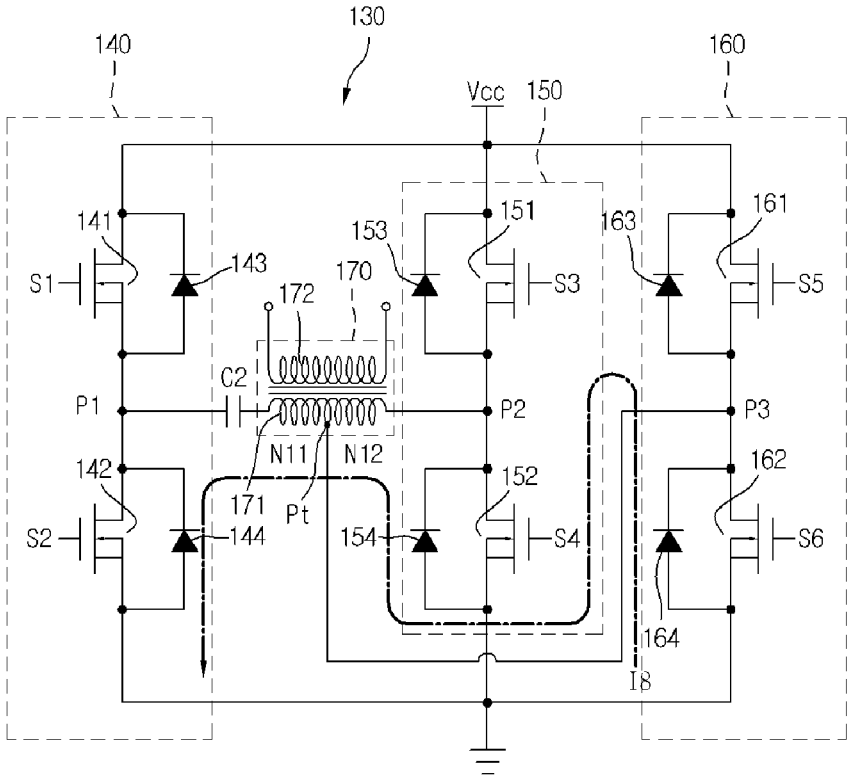

[Fig. 11]
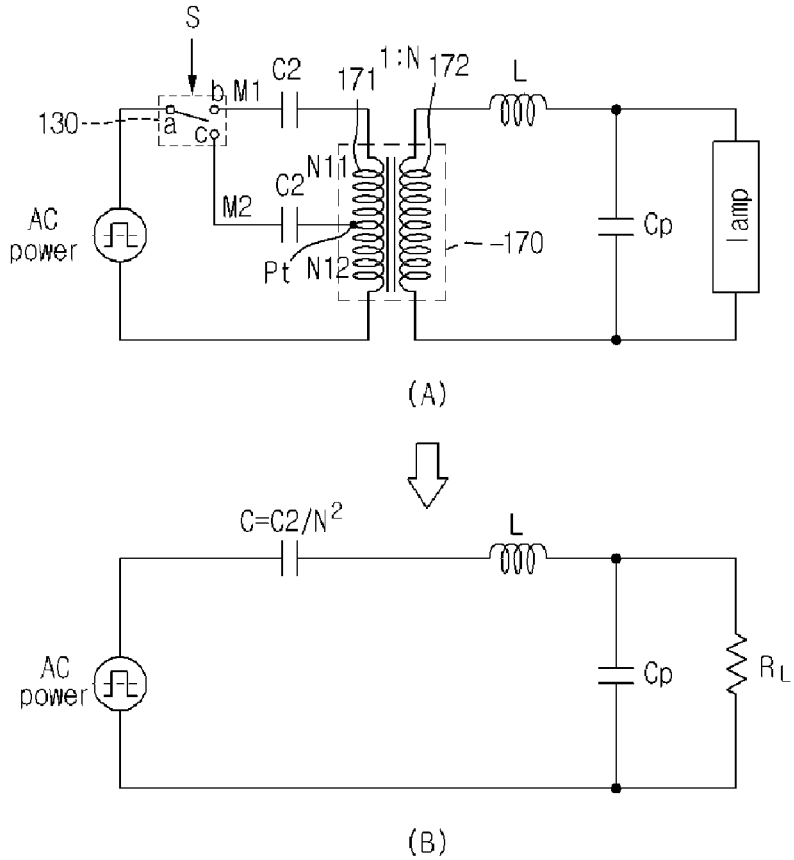
[Fig. 12]
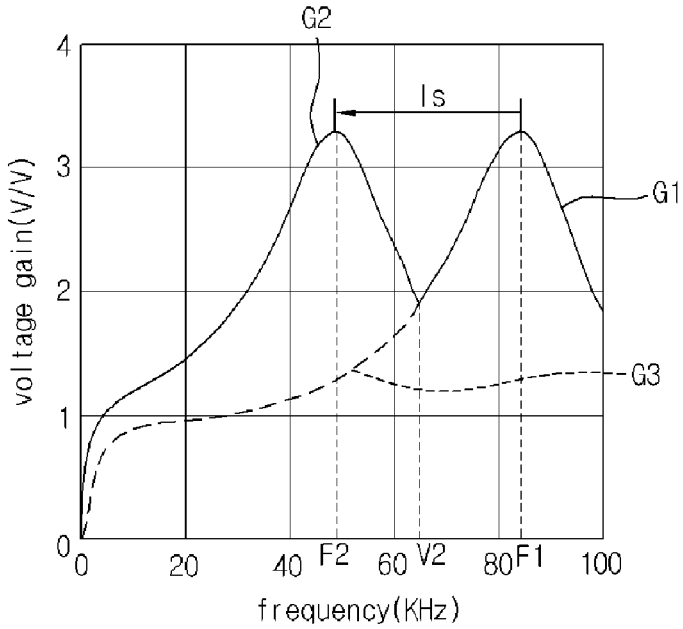

INVERTER CIRCUIT AND LAMP CONTROL APPARATUS HAVING THE SAME

CROSS-REFERENCE TO RELATED APPLICATION

This application is the U.S. national stage application of International Patent Application No. PCT/KR2008/002181, filed Apr. 17, 2008, the disclosure of which is hereby incorporated by reference in its entirety.

TECHNICAL FIELD

The embodiment relates to an inverter circuit and a lamp control apparatus having the same.

BACKGROUND ART

Since a LCD (liquid crystal device) not only has small weight and slim size but also low power consumption, the LCD has been extensively used. Thus, the LCD has been used for office automation equipment, audio/video apparatus and the like.

The LCD displays a desired image on a screen by adjusting image signals, which are applied to a plurality of switch devices arranged in a matrix type, and the amount of transmitted light.

Since such an LCD is not a self-emitting display device, the LCD requires a light source such as a backlight unit. A CCFL (cold cathode fluorescent lamp) is used as a light source for a backlight unit.

Since the CCFL has low operation current, low power consumption, low heating, high brightness, long life span and the like, the CCFL has been recently used as a light source for a backlight unit of a TFT-LCD and the like. In order to light a lamp such as the CCFL, high AC voltage is required. In order to provide the high AC voltage, a DC/AC converter is used.

DISCLOSURE OF INVENTION

Technical Problem

The embodiment provides an inverter circuit having a plurality of resonance points and a lamp control apparatus having the same.

The embodiment provides an inverter circuit capable of varying a resonance frequency according to battery voltage, and a lamp control apparatus having the same.

The embodiment provides an inverter circuit capable of varying inductance according to battery voltage by adding a half-bridge circuit to a part of a primary coil of a transformer connected with a full-bridge circuit, and a lamp control apparatus having the same.

The embodiment provides an inverter circuit capable of expanding a range of a driving frequency by varying a maximum resonance point and a resonance area according to driving of switch devices, and a lamp control apparatus having the same.

Technical Solution

The embodiment provides an inverter circuit comprising: a transformer comprising a primary coil and a secondary coil wound at a predetermined turn ratio; a first switch circuit comprising first and second switch devices commonly connected with a first end of the primary coil of the transformer; a second switch circuit comprising third and fourth switch devices commonly connected with a second end of the primary coil of the transformer; and a third switch circuit comprising fifth and sixth switch devices commonly connected with a part of the primary coil of the transformer.

The embodiment provides an inverter circuit comprising: a transformer comprising a primary coil and a secondary coil wound at a predetermined turn ratio; a first switch circuit comprising first and second switch devices commonly connected with a first end of the primary coil of the transformer; a second switch circuit comprising third and fourth switch devices commonly connected with a second end of the primary coil of the transformer; a third switch circuit comprising fifth and sixth switch devices commonly connected with a part of the primary coil of the transformer; a capacitor connected with one of the first end or the second end of the primary coil of the transformer; and a controller controlling gate-driving signals of the first to sixth switch devices according to a level of input power.

The embodiment provides a lamp control apparatus comprising: a switching unit comprising first to third switch circuits having complementary symmetrical switch devices; a transformer comprising primary and secondary coils, the primary coil having both ends connected with a common connection terminal of the first and second switch circuits, the primary coil having a tap connected with a common connection terminal of the third switch circuit a capacitor connected between the primary coil of the transformer and the first switch circuit a lamp connected with the secondary coil of the transformer; and a controller controlling a first driving mode, which uses the first and second switch circuits, and a second driving mode, which uses the first and third switch circuits, according to a level of battery voltage.

Advantageous Effects

The embodiment enables a high-efficiency operation in a wide driving frequency range.

The embodiment can provide an inverter circuit capable of generating two or more resonance points.

The embodiment can improve the efficiency of an inverter.

The embodiment can reduce power consumption.

The embodiment can increase the battery life span.

The embodiment enables battery voltage to be efficiently used in an inverter circuit for a backlight unit of a portable computer.

BRIEF DESCRIPTION OF THE DRAWINGS

FIG. 1 is a block diagram of a lamp control apparatus according to the embodiment;

FIG. 2 is a detailed circuit diagram of the switching unit of FIG. 1;

FIGS. 3 to 10 are circuit diagram illustrating an operation state of the switch circuit of FIG. 2;

FIG. 11 is a circuit diagram schematically illustrating the switch circuit of FIG. 2 and an equivalent circuit diagram of the switch circuit.

FIG. 12 is a graph showing a driving frequency of a transformer as a function of voltage gain.

BEST MODE FOR CARRYING OUT THE INVENTION

Figure 13:
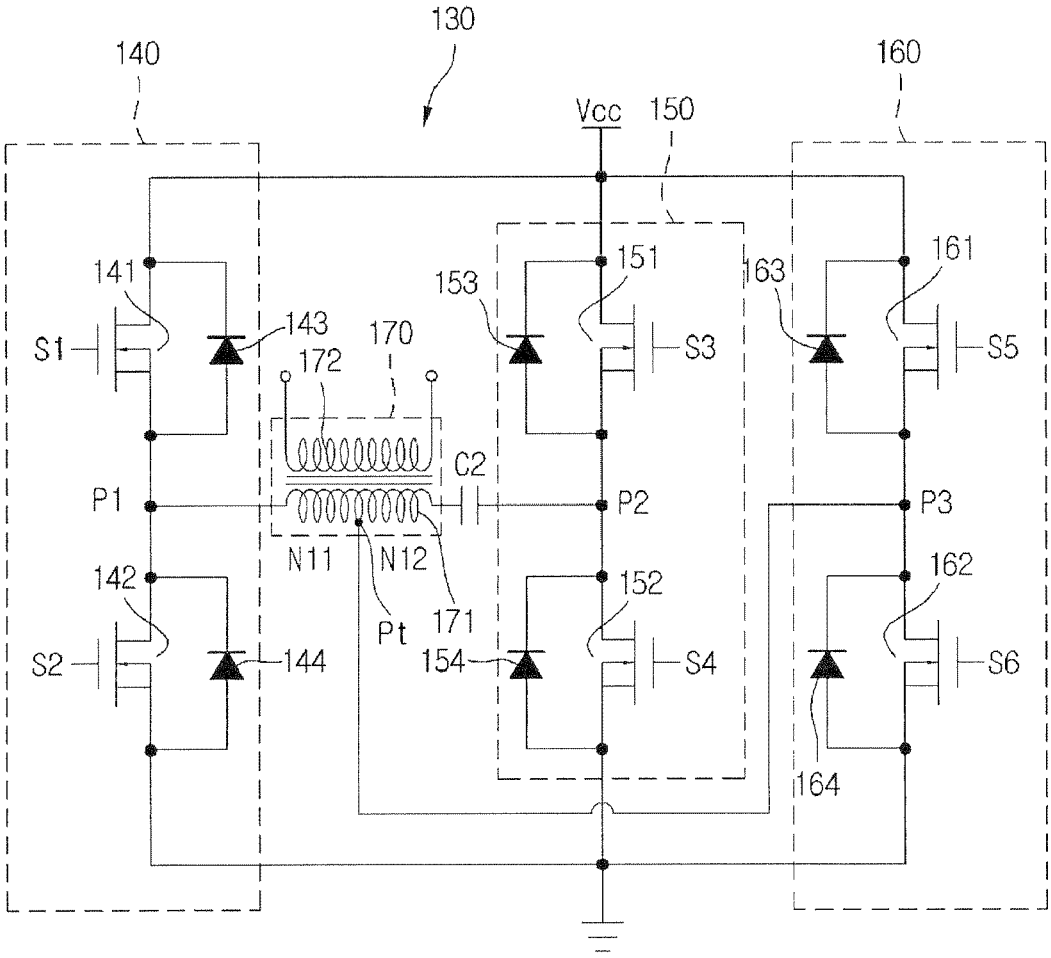
FIG. 13 is a detailed circuit diagram of the switching unit of FIG. 1 according to another embodiment.

Hereinafter, an embodiment will be described with reference to accompanying drawings.

FIG. 1 is a block diagram of a lamp control apparatus according to the embodiment.

Referring to FIG. 1, the lamp control apparatus 100 comprises a signal generator 110, a controller 120, a switching unit 130, a transformer 170, a lamp 180 and a feedback unit 190.

The signal generator 110 outputs an oscillation signal or a chopping wave signal for PWM (pulse width modulation) to the controller 120. The controller 120 outputs a gate-driving signal to the switching unit 130 by using the signal received from the signal generator 110. Further, the controller 120 outputs a gate-driving signal for controlling a driving mode of the switching unit 130 according to the level of input power, e.g. battery voltage.

The switching unit 130 comprises a plurality of switch devices driven by the gate-driving signal. the switching unit 130 is an inverter and can be embedded at least three half-bridge circuits, in which the switching unit 130 can be driven in a full-bridge scheme by using at least two half-bridge circuits the switching unit 130 performs a DC-DC converter function by switching input power to supply the power to the transformer 170.

Further, the switching unit 130 is connected with a primary coil of the transformer 170 and forms paths for two driving modes M1 and M2 by the gate-driving signal of the controller 120. For example, the first driving mode M1 is executed when the input power, e.g. the battery voltage, is greater than predetermined voltage. The second driving mode M2 is executed when the battery voltage is less than the predetermined voltage or when a driving frequency increases.

Such a switching unit 130 can vary a resonant frequency by adjusting inductance of the transformer 170 through the paths for two driving modes M1 and M2. Thus, a range of a driving frequency of the transformer 170 can be expanded, the efficiency of the inverter can be improved and the life span of a battery can be extended.

The transformer 170 performs a DC-AC converter function and outputs by boosting the input power of the switching unit 130 to high voltage by a turn ratio of a primary coil and a secondary coil. The voltage boosted by the transformer 170 is supplied to the lamp 180, so that the lamp 180 is turned on.

The state of the lamp 180 is detected through the feedback unit 190. The state of the lamp 180 detected by the feedback unit 190 is transferred to the controller 120. Such a lamp state signal can be used for preventing the transformer 170 from operating when the lamp 180 is in an open state. Such a lamp state signal can be transferred to the controller 120 through another path. The scope of the present invention is not limited thereto.

At least one lamp 180 can be connected with the secondary coil of the transformer 170. Further, the lamp 180 comprises at least one of a CCFL, an EEFL (external electrode fluorescent lamp), a HCFL (hot cathode fluorescent lamp) and an EIFL (external & internal fluorescent lamp), in which high-high voltage or high-low voltage is applied to both ends thereof.

Such a lamp control apparatus 100 can be embedded in a portable computer and a broadcasting receiver, and the controller 120, the switching unit 130 and the transformer 170 can be prepared in plural.

FIG. 2 is a detailed circuit diagram of the switching unit of FIG. 1.

Referring to FIG. 2, the switching unit 130 comprises three switch circuits 140, 150 and 160. The first to third switch circuits 140, 150 and 160 can be embedded in the form of half-bridge circuits, respectively. The switching unit 130 operates as a full-bridge circuit by using two half-bridge circuits.

The first switch circuit 140 comprises first and second switch devices 141 and 142, the second switch circuit 150 comprises third and fourth switch devices 151 and 152, and the third switch circuit 160 comprises fifth and sixth switch devices 161 and 162.

Battery power (input power Vcc) is connected with the drain terminals of the first, third and fifth switch devices 141, 151 and 161. The source terminal of the first switch device 141 is connected with the drain terminal of the second switch device 142. The source terminal of the third switch device 151 is connected with the drain terminal of the fourth switch device 152. The source terminal of the fifth switch device 161 is connected with the drain terminal of the sixth switch device 162.

The ground or sub-power is connected with the source terminals of the second, fourth and sixth switch devices 142, 152 and 162. Further, gate-driving signals S1 to S6 are input to the gate terminals of the first to six switch devices 141, 142, 151, 152, 161 and 162, respectively, so that they are turned on or off.

Diodes 143, 144, 153, 154, 163 and 164 arranged in the reverse direction are connected between the drain terminals and the source terminals of the first to six switch devices 141, 142, 151, 152, 161 and 162, respectively. Such diodes 143, 144, 153, 154, 163 and 164 serve as body diodes, and are used for discharging energy ac-cumulated in the transformer 170 to protect an internal circuit.

The first to six switch devices 141, 142, 151, 152, 161 and 162 can use various switch devices such as MOSFETs (metal-oxide semiconductor field effect transistors) or transistors. For example, the first to six switch devices 141, 142, 151, 152, 161 and 162 can be prepared in the form of an N type MOSFET. Further, the first, third and fifth switch devices 141, 151 and 161 can be prepared in the form of a P type MOSFET (or N type MOSFET), and the second, fourth and sixth switch devices 142, 152 and 162 can be prepared in the form of an N type MOSFET (or P type MOSFET).

Further, the first to six switch devices 141, 142, 151, 152, 161 and 162 can be prepared in the form of at least one of P type and N type MOSFETs. Furthermore, the switch circuits 140, 150 and 160 can also be prepared in the form of a complementary symmetrical switch device, respectively. Hereinafter, for convenience of description, the first to six switch devices 141, 142, 151, 152, 161 and 162 are N type MOSFETs, respectively.

Both ends of the primary coil 171 of the transformer 170 are connected with common connection terminals P1 and P2 of the first and second switch circuits 140 and 150. In detail, the common connection terminal P1 between the source terminal of the first switch device 141 and the drain terminal of the second switch device 142 is connected with one end of the primary coil 171 of the transformer 170. Further, the common connection terminal P2 between the source terminal of the third switch device 151 and the drain terminal of the fourth switch device 152 is connected with the other end of the primary coil 171 of the transformer 170.

A capacitor C2 is connected between the primary coil 171 of the transformer 170 and the common connection terminal P1 of the first switch circuit 140. For example, the capacitor C2 can be serially connected the primary coil 171 of the transformer 170.

The capacitance of the capacitor C2 and the inductance of the primary coil 171 of the transformer 170 resonate with a resonance frequency. The capacitor C2 can be serially connected with one end or the other end of the primary coil 171 of the transformer 170. For example, FIG. 2 shows the capacitor C2 at one end of the primary coil 171 and FIG. 13 shows the capacitor C2 at the other end of the primary coil 171.

The third switch circuit 160 is connected with an intermediate tap Pt of the primary coil 171 of the transformer 170. In detail, the intermediate tap Pt is connected with a common connection terminal P3 between the source terminal of the fifth switch device 161 of the third switch circuit 160 and the drain terminal of the sixth switch device 162.

The third switch circuit 160 and the first switch circuit 140 are connected with one part N11 of the primary coil 171 of the transformer 170, and the third switch circuit 160 and the second switch circuit 150 are connected with the other part N12 of the primary coil 171 of the transformer 170. Thus, the third switch circuit 160 can operate as a full-bridge together with the first switch circuit 140 or the second switch circuit 150 according to the position of the capacitor C2.

The third switch circuit 160 can be connected with the intermediate tap Pt of the primary coil 171 of the transformer 170, and the connection point of the intermediate tap Pt can be changed. For example, when the primary coil 171 of the transformer 170 is divided into N coils, the connection point of the intermediate tap Pt is greater than or equal to ½ and is smaller than or equal to 1/N (N is an integer of 2 or more).

The first and second switch circuits 140 and 150 operate as one full-bridge circuit. Further, the first and third switch circuits 140 and 160, or the second and third switch circuits 150 and 160 may also operate as another full-bridge circuit.

A load (i.e. lamp) is connected to the secondary coil 172 of the transformer 170. At this time, in the first driving mode, the controller 120 applies electric current to the primary coil 171 of the transformer 170 by using the first and second switch circuits 140 and 150, and induces high-voltage electric current to the secondary coil 172 of the transformer 170, thereby driving the lamp. In the first driving mode, the resonance frequency of the transformer 170 is determined by the inductance of the primary coil 171 of the transformer 170 and the capacitance of the capacitor C2.

Further, in the second driving mode, the controller 120 applies electric current to one part N11 of the primary coil 171 of the transformer 170 by using the first and third switch circuits 140 and 160, and induces high-voltage electric current to the secondary coil 172 of the transformer 170, thereby driving the lamp. In the second driving mode, the resonance frequency of the transformer 170 is determined by the inductance of one part N11 of the primary coil 171 of the transformer 170 and the capacitance of the capacitor C2.

Since the inductance in the second driving mode is smaller than that in the first driving mode, the resonance frequency is relatively increased.

FIGS. 3 to 10 are circuit diagram illustrating an operation state of the switch circuit of FIG. 2. FIGS. 3 to 6 are circuit diagram illustrating a current path in the first driving mode and FIGS. 7 to 10 are circuit diagram illustrating a current path in the second driving mode.

Referring to FIG. 3, the first and fourth switch devices 141 and 152 are turned on by the first and fourth gate-driving signals S1 and S4, and the second, third, fifth and sixth switch devices 142, 151, 161 and 162 are in an off state.

The input power Vcc flows through a path I1, i.e. the first switch device 141, the capacitor C2, the primary coil 171 of the transformer 170 and the fourth switch device 152. At this time, the direction of the current flowing in the primary coil 171 of the transformer 170 is a first direction.

Referring to FIG. 4, after the operation interval of FIG. 3, the first, second, third, fifth and sixth switch devices 141, 142, 151, 161 and 162 are turned off, and the fourth switch device 152 maintains an on state. At this time, the first and second switch devices 141 and 142 are in an off state until the second gate-driving signal S2 becomes a high level, so that pass-through current can be prevented from flowing. Since the fourth switch device 152 maintains an on state, electric current accumulated in the transformer 170 flows into the ground through a path I2, i.e. the diode 144 of the second switch device 142, the capacitor C2, the primary coil 171 of the transformer 170 and the fourth switch device 152.

At this time, electric current flowing in the first direction due to accumulation energy of the transformer 170 becomes a zero state, so that the current direction in the primary coil 171 of the transformer 170 changes into the second direction. Such a driving state is referred to as zero switching, e.g. ZVS (zero voltage switching) or ZCS (zero current switching), and is maintained in order to obtain delay time in the inverter driving circuit. If switching is suddenly performed in the inverter circuit, short or spark may occur by remaining current. Thus, the zero switching state is maintained for a predetermined time in order to prevent the short or spark from occurring. In the zero switching state, the remaining current is discharged through the ground, so that another circuit can be protected.

Referring to FIG. 5, the third and second switch devices 151 and 142 are turned on by the high level of the third and second gate-driving signals S3 and S2, and the first, fourth, fifth and sixth switch devices 141, 152, 161 and 162 are turned off. As the third and second switch devices 151 and 142 are turned on, the input power Vcc flows through a path I3, i.e. the third switch device 151, the primary coil 171 of the transformer 170, the capacitor C2 and the second switch device 142. At this time, electric current flows in the primary coil 171 of the transformer 170 in the second direction.

Referring to FIG. 6, the third switch device 151 is turned off and the second switch device 142 maintains an on state. At this time, electric current accumulated in the transformer 170 flows into the ground through a path I4, i.e. the diode 154 of the fourth switch device 152, the primary coil 171 of the transformer 170, the capacitor C2, and the second switch device 142.

Further, electric current in the second direction due to the accumulation energy of the transformer 170 becomes a zero state, so that the current direction in the primary coil 171 of the transformer 170 changes into the first direction. In such a zero switching state, the remaining current is discharged through the ground, so that another circuit is protected.

Then, if the fourth gate-driving signal S4 becomes a high level, the fourth switch device 152 is turned on by the fourth gate-driving signal S4. At this time, electric current flowing into the diode 154 of the fourth switch device 152 is shifted to a channel of the fourth switch device 152. Then, electric current flows through the current path I1 of FIG. 3.

As descried above, the switching operation is repeated, in which the direction of electric current flowing in the primary coil 171 of the transformer 170 is changed from the first direction to the second direction or from the second direction to the first direction by the gate-driving signals S1 to S4 of the first and second switch circuits 140 and 150.

The full-bridge circuit using the first and second switch circuits 140 and 150 operates in the first driving mode. The first driving mode is executed when the battery voltage is greater than predetermined voltage (comprising full charge voltage).

When the battery voltage is less than the predetermined voltage or when the driving frequency increases, the switching unit 130 operates in the second driving mode. In the second driving mode, the full-bridge circuit operates using the first and the third switch circuits 140 and 160. Further, in the second driving mode, the second and the third switch circuits 150 and 160 may be used. In such a case, the capacitor C2 can be serially connected with the other end of the primary coil 171 of the transformer 170.

FIGS. 7 to 10 are circuit diagram illustrating the current path in the second driving mode.

Referring to FIG. 7, the first switch device 141 of the first switch circuit 140 and the sixth switch device 162 of the third switch circuit 160 are turned on by the high level of the first to sixth gate-driving signals S1 to S6, and the second to fifth switch devices 142, 151, 152 and 161 are in an off state.

At this time, the input power Vcc flows through a path I5, i.e. the first switch device 141, the capacitor C2, one part N11 of the primary coil 171 of the transformer 170, and the sixth switch device 162. Further, electric current flows in the primary coil 171 of the transformer 170 in the first direction.

Since the intermediate tap Pt of the third switch circuit 160 is connected with one part N11 of the primary coil 171 of the transformer 170, the resonance frequency is increased by the inductance of one part N11 of the primary coil 171 of the transformer 170 and the capacitor C2.

In detail, since only one part N11 is used in the second driving mode instead of the primary coil 171, the resonance frequency is relatively increased, and high-efficiency operation can be performed in a high driving frequency band.

Referring to FIG. 8, after the operation interval of FIG. 7, the first switch device 141 is turned off and the sixth switch device 162 maintains an on state. At this time, electric current accumulated in the transformer 170 flows into the ground through a path I6, i.e. the diode 144 of the second switch device 142, the capacitor C2, one part N11 of the primary coil 171 of the transformer 170, and the sixth switch device 162. Such an operation scheme is referred to the zero switching (e.g. ZVS or ZCS). In such a zero switching state, the remaining current is discharged through the ground, so that another circuit is protected.

Then, if the second gate-driving signal S2 becomes a high level, the second switch device 142 is turned on by the second gate-driving signal S2. At this time, electric current flowing into the diode 144 of the second switch device 142 is shifted to a channel of the second switch device 142.

Referring to FIG. 9, in the zero switching state of FIG. 8, the second switch device 142 is turned on and the fifth switch device 161 is turned on by the high level of the fifth gate-driving signal S5. Further, the first, third, fourth and sixth switch devices 141, 151, 152 and 162 are in an off state.

At this time, the input power flows through a path I7, i.e. the fifth switch device 161, one part N11 of the primary coil 171 of the transformer 170, the capacitor C2 and the second switch device 142. Further, electric current flows in the primary coil 171 of the transformer 170 in the second direction.

Referring to FIG. 10, the fifth switch device 161 is turned off and the second switch device 142 maintains an on state. At this time, electric current accumulated in the transformer 170 flows into the ground through a path I8, i.e. the diode 164 of the sixth switch device 162, one part N11 of the primary coil 171 of the transformer 170, the capacitor C2 and the second switch device 142. Such an operation scheme is referred to the zero switching (e.g. ZVS or ZCS). In such a zero switching state, the remaining current is discharged through the ground, so that another circuit is protected.

Then, if the sixth gate-driving signal S6 becomes a high level, the sixth switch device 162 is turned on by the sixth gate-driving signal S6. At this time, electric current flowing into the diode 164 of the sixth switch device 162 is shifted to a channel of the sixth switch device 162. Then, the operation state of FIG. 7 is repeated.

At this time, the first and third switch circuits 140 and 160, which repeat such a switching operation of FIGS. 7 to 10, are switched into the second driving mode.

The embodiment uses two driving modes through the three switch circuits 140, 150 and 160. However, as a plurality of third switch circuits are connected with a predetermined tap of the primary coil of the transformer 170, two or more driving modes can be provided. Further, the transformer 170 may operate with different frequencies according to each driving mode.

In addition, the second driving mode, for example, may use the second and third switch circuits 150 and 160. In detail, the second driving mode comprises a current path formed in the first direction of one part N12 of the primary coil 171 of the transformer 170 due to the driving of the third and sixth switch devices 151 and 162, and a current path formed in the second direction of the other part N12 of the primary coil 171 of the transformer 170 due to the driving of the fifth and fourth switch devices 161 and 152.

FIG. 11 is a circuit diagram schematically illustrating the construction of the switch circuit according to the embodiment. FIG. 11A is a circuit diagram schematically illustrating the switch circuit and FIG. 11B is an equivalent circuit diagram of the switch circuit of FIG. 11A.

Referring to FIGS. 11A and 11B, the switching unit 130 controls input power AC to flow through a path (a-b) of the first driving mode M1 or a path (a-c) of the second driving mode M2 according to the gate-driving signal S.

The capacitor C2 is serially connected with the primary coil 171 of the transformer 170 or one part N11 of the primary coil 171, and a leakage inductance L is serially connected with the second coil 172 of the transformer 170. Further, a parallel capacitor Cp is connected with both ends of the second coil 172.

At this time, the first driving mode M1 uses the capacitor C2 and inductance of the primary coil 171 of the transformer 170, and the second driving mode M2 uses the capacitor C2 and inductance of one part N11 of the primary coil 171 of the transformer 170.

The power applied to the primary coil 171 of the transformer 170, and one part N11 of the primary coil 171 is boosted up by a turn ratio (1:N) with the second coil 172 and then is supplied to the lamp or the load.

At this time, the resonance frequency of the transformer 170 is determined by the capacitor C2 and the inductance of the primary coil 171 of the transformer 170 or the inductance of one part N11 of the primary coil 171. Further, since the inductance of one part N11 of the primary coil 171 is smaller than that of the primary coil 171, the resonance frequency is relatively increased, and high-efficiency operation can be performed in a high driving frequency band.

In the circuit diagram of FIG. 11, the driving frequency F of the transformer 170 is greater than a resonance frequency Fs and is smaller than a parallel resonance frequency Fp.

The resonance frequency Fs and the parallel resonance frequency Fp can be expressed by equations below.

$$Fs = \frac{1}{2\pi\sqrt{LC2}}$$

$$Fp = \frac{1}{2\pi\sqrt{L\frac{C2Cp}{C2+Cp}}}$$

In resonance frequency Fs and the parallel resonance frequency Fp, since the capacitor C2 has the same value and the inductance L of the primary coil 171 of the transformer 170 is reduced to the inductance (L/2) of one part N11 of the primary coil 171, the resonance frequency of the transformer 170 is relatively increased.

FIG. 12 is a graph showing the driving frequency of the transformer as a function of voltage gain.

Referring to FIG. 12, as battery charge voltage is increased, the driving frequency is increased and the voltage gain is also increased. The voltage gain uses a level of about 2V to 3V.

If the battery voltage is greater than predetermined voltage V2, the voltage gain (V/V) is positioned at the apex, and the inverter circuit is driven with a first driving frequency within the range of a first resonance frequency. For example, in a system such as a portable computer, when the battery voltage is greater than 14V corresponding to ⅔ of full charge voltage 21V, the portable computer is driven within the range (e.g. 65 KHz to 100 KHz) of the first driving frequency. In detail, the first driving frequency graph G1 is used when the battery voltage is greater than the predetermined voltage.

Further, when the battery voltage is less than the predetermined voltage V2, the inverter circuit is driven with a second driving frequency (e.g. 1 KHz to 64 KHz) within the range of a second resonance frequency. At this time, the voltage gain (V/V) is positioned at the apex. In detail, the second driving frequency graph G2 is used when the battery voltage is less than the predetermined voltage.

The first driving frequency exists within the range of 65 Hz to 100 Hz, the second driving frequency exists within the range of 1 Hz to 64 Hz, and the second resonance frequency F2 is shifted from the first resonance frequency F1 by Is.

Further, a third driving frequency graph G3 is a graph when the transformer operates in the first driving mode instead of the second driving mode of FIG. 2.

According to the embodiment, when the battery voltage is the predetermined voltage by the driving mode of the switching unit, the lamp control apparatus operates with the first resonance frequency. However, when the battery voltage is less than the predetermined voltage, the lamp control apparatus operates with the second resonance frequency. The range of the resonance frequency having the maximum efficiency is widened by such resonance characteristics.

Further, the inverter circuit can be used in a wide driving frequency range as compared with an inverter for an LCD backlight unit of a terminal such as a portable computer, and input voltage can be efficiently used.

According to the embodiment, the efficiency of the inverter can be improved, power consumption can be reduced and the battery life span can be extended.

Although embodiments have been described with reference to a number of illustrative embodiments thereof, it should be understood that numerous other modifications and embodiments can be devised by those skilled in the art that will fall within the spirit and scope of the principles of this disclosure.

INDUSTRIAL APPLICABILITY

The embodiment enables a high-efficiency operation in a wide driving frequency range.

The embodiment can provide an inverter circuit capable of generating two or more resonance points.

The embodiment can improve the efficiency of an inverter.

The embodiment can reduce power consumption.

The embodiment can increase the battery life span.

The embodiment enables battery voltage to be efficiently used in an inverter circuit for a backlight unit of a portable computer.

The invention claimed is:

1. An inverter circuit comprising:

a transformer comprising a primary coil and a secondary coil wound at a predetermined turn ratio;

a first switch circuit comprising first and second switch devices commonly connected with a first end of the primary coil of the transformer;

a second switch circuit comprising third and fourth switch devices commonly connected with a second end of the primary coil of the transformer; and a third switch circuit comprising fifth and sixth switch devices commonly connected with a part of the primary coil of the transformer.

2. The inverter circuit as claimed in claim 1, wherein the first to sixth switch devices comprise a MOSFET or a transistor, input power is connected with first ends of the first, third and fifth switch devices, and second ends of the second, fourth and sixth switch devices are grounded.

3. The inverter circuit as claimed in claim 1, wherein at least one of the first to sixth switch devices comprises an N-channel MOSFET or a P-channel MOSFET.

4. The inverter circuit as claimed in claim 1, wherein the fifth and sixth switch devices of the third switch circuit are commonly connected with an intermediate tap of the primary coil of the transformer.

5. The inverter circuit as claimed in claim 1, wherein the fifth and sixth switch devices of the third switch circuit are connected with the part of the primary coil of the transformer, and the connection point is greater than or equal to ½ and is smaller than or equal to 1/N (N is an integer of 2 or more) when the primary coil is divided into N coils.

6. The inverter circuit as claimed in claim 1, comprising a capacitor connected with the first end or the second end of the primary coil of the transformer.

7. The inverter circuit as claimed in claim 6, comprising a diode connected in parallel between drain terminals and source terminals of the first switch device in a reverse direction, a diode connected in parallel between drain terminals and source terminals of the second switch device in a reverse direction, a diode connected in parallel between drain terminals and source terminals of the third switch device in a reverse direction, a diode connected in parallel between drain terminals and source terminals of the fourth switch device in a reverse direction, a diode connected in parallel between drain terminals and source terminals of the fifth switch device in a reverse direction, and a diode connected in parallel between drain terminals and source terminals of the sixth switch device in a reverse direction.

8. The inverter circuit as claimed in claim 6, wherein the first and second switch circuits are driven in a first driving mode when input voltage is greater than predetermined voltage, and the third and first switch circuits or the third and second switch circuits are driven in a second driving mode when input voltage is less than the predetermined voltage.

9. The inverter circuit as claimed in claim 8, wherein the first driving mode comprises a current path formed in a first direction of the primary coil of the transformer due to driving of the first and fourth switch devices, and a current path formed in a second direction of the primary coil of the transformer due to driving of the third and second switch devices.

10. The inverter circuit as claimed in claim 8, wherein the second driving mode comprises a current path formed in the first direction of the part of the primary coil of the transformer due to driving of the first and sixth switch devices, and a current path formed in the second direction of the part of the primary coil of the transformer due to driving of the fifth and second switch devices.

11. The inverter circuit as claimed in claim 8, wherein the second driving mode comprises a current path formed in the first direction of the part of the primary coil of the transformer due to driving of the third and sixth switch devices, and a current path formed in the second direction of the part of the primary coil of the transformer due to driving of the fifth and fourth switch devices.

12. An inverter circuit comprising:

a transformer comprising a primary coil and a secondary coil wound at a predetermined turn ratio;

a first switch circuit comprising first and second switch devices commonly connected with a first end of the primary coil of the transformer;

a second switch circuit comprising third and fourth switch devices commonly connected with a second end of the primary coil of the transformer;

a third switch circuit comprising fifth and sixth switch devices commonly connected with a part of the primary coil of the transformer;

a capacitor connected with one of the first end or the second end of the primary coil of the transformer; and a controller controlling gate-driving signals of the first to sixth switch devices according to a level of input power.

13. The inverter circuit as claimed in claim 12, wherein, when the level of the input power is greater than ⅔, the controller drives the first and second switch circuits as a full-bridge circuit.

14. The inverter circuit as claimed in claim 12, wherein, when the level of the input power is less than ⅔, the controller drives the first and third switch circuits or the second and third switch circuits as a full-bridge circuit.

15. The inverter circuit as claimed in claim 12, wherein a driving frequency of the transformer is increased according to variation in inductance due to driving of the third switch circuit.

16. The inverter circuit as claimed in claim 12, wherein the third switch circuit is prepared in plural, and the plural third switch circuits are connected between the first and second ends of the primary coil of the transformer at different positions.

17. A lamp control apparatus comprising:

a switching unit comprising first to third switch circuits having complementary symmetrical switch devices;

a transformer comprising primary and secondary coils, the primary coil having both ends connected with a common connection terminal of the first and second switch circuits, the primary coil having a tap connected with a common connection terminal of the third switch circuit;

a capacitor connected between the primary coil of the transformer and the first switch circuit;

a lamp connected with the secondary coil of the transformer; and a controller controlling a first driving mode, which uses the first and second switch circuits, and a second driving mode, which uses the first and third switch circuits, according to a level of battery voltage.

18. The lamp control apparatus as claimed in claim 17, wherein the first to third switch circuits comprise plural switch devices, respectively, one of the switch devices is an N-type MOSFET, and a remaining one is a P-type MOSFET or an N-type MOSFET.

19. The lamp control apparatus as claimed in claim 17, wherein, when a level of the battery voltage is less than predetermined voltage, the controller switches a mode from the first driving mode to the second driving mode.

20. The lamp control apparatus as claimed in claim 17, wherein at least one lamp is connected to the secondary coil of the transformer, and the lamp comprises at least one of a CCFL (cold cathode fluorescent lamp), an EEFL (external electrode fluorescent lamp), a HCFL (hot cathode fluorescent lamp) and an EIFL (external & internal fluorescent lamp), in which high-high voltage or high-low voltage is applied to both ends thereof.

* * * * *